US006769602B1

(12) United States Patent
Rottem

(10) Patent No.: US 6,769,602 B1
(45) Date of Patent: Aug. 3, 2004

(54) FETO-MATERNAL CALENDAR CALCULATOR

(76) Inventor: Shraga Rottem, 69-40 Fleet St., Forest Hills, NY (US) 11355

( * ) Notice: Subject to any disclaimer, the term of this patent is extended or adjusted under 35 U.S.C. 154(b) by 0 days.

(21) Appl. No.: 09/787,034

(22) PCT Filed: Mar. 6, 1997

(86) PCT No.: PCT/US97/04127

§ 371 (c)(1),
(2), (4) Date: Mar. 12, 2001

(87) PCT Pub. No.: WO97/33214

PCT Pub. Date: Sep. 12, 1997

Related U.S. Application Data

(60) Provisional application No. 60/012,956, filed on Mar. 6, 1996.

(51) Int. Cl.[7] ..... G06C 3/00

(52) U.S. Cl. ..... 235/88 RC; 235/78 RC; 235/78 R; 235/88 R

(58) Field of Search ..... 235/78 RC, 78 R, 235/88 RC, 88 R, 85 FC

(56) References Cited

U.S. PATENT DOCUMENTS

| | | | | | |
|---|---|---|---|---|---|
| 2,418,207 | A | * | 4/1947 | Tilbrook | 235/78 RC |
| 4,133,476 | A | * | 1/1979 | Poage et al. | 235/85 FC |
| 5,763,860 | A | * | 6/1998 | Denis et al. | 235/78 R |
| 5,777,905 | A | * | 7/1998 | Dowdle et al. | 708/142 |
| 5,928,168 | A | * | 7/1999 | Laros, Jr. | 600/588 |

* cited by examiner

*Primary Examiner*—Karl D. Frech
(74) *Attorney, Agent, or Firm*—Greenberg Traurig LLP; Eugene C. Rzucidlo

(57) ABSTRACT

A feto-maternal calendar calculator (10) provides for calculating the gestational age of a fetus from the calendar date of the mother's last menstrual cycle. Using the calculated gestational age, the user of the calendar calcalator may determine appropriate growth of fetal organs, determine the earliest time for detection of fetal anomalies, establish periods of risk to the fetus from drugs used by the mother, determine the appropriate times for testing for fetal anomalies, genetic abnormalities, or other fetal biochemical milestones. The calendar calculator of the present invention is designed for ease of use and for providing information previously unavailable to obstetricians and diagnostic technicians.

13 Claims, 5 Drawing Sheets

OBSERVATIONS ON THE ULTRASONOGRAPHICALLY STATISTICALLY SIGNIFICANT DETECTION OF FETAL ORGANS(0-40 WEEKS, MENSTRUAL AGE)

32 59 62 56 53

| | CNS | CARD/VASC THORAX | URINARY ADRENAL GENIT | G.I. SYST ABD. WALL | SKELETON | NOSE EAR/FACE EYE/NECK | OTHERS | |
|---|---|---|---|---|---|---|---|---|
| 40 Wks | | | | | | | | 40 Wks |
| 16 | | | | Gallbladder | | | | 16 |
| 15 | | | Adrenal Gland | | | | | 15 |
| 14 | | Trachea | Sex(F) | | | | | 14 |
| | | | Sex(M) | Esophagus | | | | |
| 13 | | Pulmonary Art. Four Ch. View AV Valves | Renal Pelvis | Bowels | Ulna Fibula Tibia Radius Ribs | | | 13 |
| 12 | Willis Circle Thalamus Cerebellum | Carotid Art. Brachiceph Art. Lungs | Urin. Bladder Kidneys | | Toes Clavicle Femur Fingers | Lens Ears Jaws Nose NeckOutline | | 12 |
| 11 | Cist. Magna Cereb. Hemisph. | Ventr. Sept. Rt. Ventr. Wall Lt. Ventr. Wall | | Stomach Diaph. Area Liver | | Orbits | Genit. Tuberc. | 11 |
| 10 | Falx | | | Cord Insert. | | | | 10 |
| 9 | Spinal Med. Mesenceph. Chor. Plex | Aorta | | | | | | 9 |
| 8 | Spinal Tract | Umb. Circ. | | | Low. Limb.B Up. Limb.B | | Amnion | 8 |
| 7 | Rhomb. Enc. Cav. | Vit. Circ. | | | | | Umb. Cord Trunk Bud. Heart Beat Embr. Pol. | 7 |
| 6 | | | | | | | Yolk Sac | 6 |
| 5 | | | | | | | Gest. Sac. | 5 |
| 0 Wks | | | | | | | | 0 Wks |

FIG. 3

65 74 74 74

| | CNS | CARD/VASC THORAX | URINARY/ ADRENAL/ GENITALIA | GASTROINT. SYST/ ABDOMINAL WALL | SKELETAL DYSPLASIAS | NOSE EAR/FACE EYE/NECK | UMB. CORD/ AMNION/ YOLK SAC/ PLACENTA/ MISC. | |
|---|---|---|---|---|---|---|---|---|
| 40 Wks | | | | | | | | 40 Wks |
| 68 | | Pulmonary Hematoma<br>Agenesis of Vena Cava<br>Aortic Stenosis<br>Endocardial Fibroelast<br>Tga/ Corrected<br>TGA<br>Double Out Rt. Ve<br>Coarctaion of Aorta<br>Mitral Atresia | Absent Genitalia<br>Adrenal Hypoplasia<br>Double Collect Syst | Gallbladder Dysmorph<br>Gallbladder Agenesis<br>Pancreatic Cyst<br>Solid Liver Tumor<br>Double Gallbladder | Focomelia<br>Adactily<br>Talipes Equinovarus<br>Arthrogripposis<br>Rockerbottom Foot<br>Clubhand | 77 | | |
| | Hydrocephalus LV | Hypoplastic Lt Heart | | | | | | |
| 15 | | Ventric. Septal Def | | | | 77 | | 15 |
| | Herniat. of Mening | Hypopl. Ascend. Aorta<br>Cardiomegaly | UPJ Obstruction | | Osteogen Imperf2 | Cleft Lip and Palate | | |
| | | | Epispadia | | Larsen Syndrome | | | |
| | Chor. Pl Dysmorph<br>Holopros/ Lobar | | Hypospadia<br>Monolat. Renal Agenesis | Mesenteric Cyst<br>Hepatomegaly | Caudal Regr. Synd.<br>Sirenomelia | Cranil Hemangioma<br>Microphtalmia | Amn. Band Syndr<br>Plac. Hypertrophy<br>Velamentous Insert | |
| | | Axilar Hygroma | | Diaphrag Hernia/Stom | Amelia (inferior)<br>Amelia (superior)<br>Campodactily<br>Hemivertebra<br>Clenched Fingers | Cataract | Single Umbil. | |
| 14 | | Septal Calcifications<br>Calcifications | | | | | Artery | 14 |
| | Spina Bifida/Closed | | Prune Belly Synd<br>Bilat Renal Agenesis | Echogenic Bowel<br>Omphalocele/Bat.L.Heart<br>Intrahep. Chaled. Cyst | | Anophtalmia<br>Arhinia | | |
| 13 | | | | | | | | 13 |
| | | Situs Inversus<br>Tetralogy of Fallot | MCKD | | | Medial Cleft Lip<br>Low Set Ears | | |
| | Meningohydroencepl<br>Iniencephaly | | Hyperecho. Dyst. Kidney | Omphalocele/Bowel | Thoracophagus<br>Hypophosphatasia<br>Scoliosis | Micrognatia | Skin Tumor<br>Arcadiac Monster<br>Sacra Cog Terat | |
| 71 | Dilated CSPV<br>Central Encephalocele | | | | Achondro II<br>Clubfoot | | TRAP<br>Mult. Pteryg. Synd. | |
| 12 | Holopros/Alobar<br>Encephalocele/Frontal<br>Hydrocephalus 3V | Agenesis of Aorta (12)<br>Exocardia (12wks)<br>Truncus Art. (12wks)<br>Perch. Nya UHL Dis (12) | Pelvic Kidney | Folding Defect<br>Urachal Cyst<br>Liver Calcifications<br>Omphalocele/Bat.L<br>Esoph Atr | Diastr. Dwarf | Proboscis<br>Cyclopus | | 12 |
| | | | Horseshoe Kidney | | | | | |
| | Anencephly<br>Spina Bifida/Open<br>Meningoencephalocele | Single Ventricle | | | | | | |
| 71 | | A-V Canal<br>Common Atrium<br>Complete Heart Block<br>A-V Valve Regurgitat | | | Omphalothoracophag | | | |
| | Dandy-Walker Malf | | Post Urethral Valve | Gastroschisis | Polydactyly | | | |
| | Encephalocele/Occip | Tubular COA | Renal Cyst | | | | | |
| 11 | Trigonocephaly | Ebstein Anomaly<br>Dextrocardia<br>Pentalogy of Cantrell | Hydronephrosis | | Jarcho Levine Syndr.<br>Syndactily | Hypotelorism | Partial Mole | 11 |
| | | | | | | | Plac. Cyst | |
| 10 | Holopros/Semilob<br>Hydranencephaly | | IPKD | | Scoliosis | | | 10 |
| | Acrania | Thoracic Hygroma<br>Pericardial Effusion | | Omphalocele/Liver | | | | |
| 9 | Intracraial Tumor<br>Choroid Plexus Cyst | Pleural Eff | | | Achondro I | Epignatus<br>Cystic Hygroma<br>Cervical Lymphedema | | 9 |
| | | | | | | | Plac Chorioangioma | |
| | | | | | | | Allantoid Cyst<br>Hydrops | |
| 8 | | | | | | | Large YS | 8 |
| 7 | | Tachyarh. | | | Omphalophagus | | | 7 |
| 0 | | | | | | | | 0 |
| Wks | | | | | | | | Wks |

FIG. 4

FETO-MATERNAL CALENDAR CALCULATOR

This application claims the benefit of prior filed U.S. provisional application Serial No. 60/012,956, filed on Mar. 6, 1996.

A portion of the disclosure of this patent document contains material which is subject to copyright protection. The copyright owner has no objection to the facsimile reproduction by anyone of the patent disclosure, as it appears in the files or records of the U.S. Patent and Trademark Office, or the patent offices of any country, but otherwise reserves all copyright rights whatsoever.

BACKGROUND OF THE INVENTION

This invention relates to a feto-maternal calendar calculator for calculating times for detection of fetal organs and fetal anomalies, as well as other prenatal tests and conditions, utilizing ultrasonogram or other diagnostic aids.

In accordance with the invention, the feto-maternal calendar calculator incorporates one or more charts with time-oriented tests, conditions, and development data, starting with 0 (zero) weeks and 0 (zero) days from the last menstrual period and ending with 40 (forty) weeks and 0 (zero) days menstrual age, and a calendar encompassing forty (40) weeks and 0 (zero) days of menstrual age.

The feto-maternal calendar calculator is preferably relatively portable.

The feto-maternal calendar calculator is preferably used to determine the length of the gestation in weeks and days from the last menstrual period, and to aid in the scheduling and interpretation of feto-maternal tests accordingly.

The calendar calculator nay include times for detecting the appearance of fetal organs and structures, fetal anomalies, normal and abnormal levels of substances in the amniotic fluid, umbilical cord, and uterus, normal and abnormal levels of substances in maternal urine and serum, genetic abnormalities in the fetus, and tests on any other feto-maternal compartments, related or not related to paternal genetic information.

The calendar calculator can present an assembly of charts according to any fetal menstrual age.

The invention is especially suitable for the following:

1. Guiding the user when to look for the ultrasonographic detection of one or more fetal organs and the development of such organs.

2. Guiding the user when to look for the ultrasonographic detection of one or more fetal anomalies.

3. Guiding the user as to the significance of the ultrasonogram and other tests. in the amniotic fluid, umbilical cord. uterus, maternal serum, urine and other feto-maternal compartments, all in relation to the menstrual age.

4. Guiding the user when to schedule feto-maternal tests.

SUMMARY OF THE INVENTION

A feto-maternal calendar calculator is provided, whereby the gestational age of a fetus is calculated from the calendar date of the mother's last menstrual cycle. Using the calculated gestational age, the user of the calendar calculator may determine appropriate growth of fetal organs, determine the earliest time for detection of fetal anomalies, establish, periods of risk to the fetus from drugs used by the mother, determine the appropriate times for testing for fetal anomalies, genetic abnormalities, or other fetal biochemical milestones. The calendar calculator of the present invention is designed for ease of use and for providing information previously unavailable to, or not conveniently accessible by, obstetricians and diagnostic technicians.

While the ultrasonogram is presently used as a primary diagnostic tool for prenatal testing, the calendar calculator may be used for other diagnostic tools, such as amniocentesis, chorionic villi sampling, and blood tests.

The feto-maternal calendar calculator is for multipurpose use throughout pregnancy.

BRIEF DRAWING DESCRIPTION

FIG. 3 is an enlarged view of the fetal organ chart 32 of FIG. 1.

FIG. 4 is an enlarged view of the fetal anomaly chart 65 of FIG. 2.

DETAILED DESCRIPTION

Figure 1:
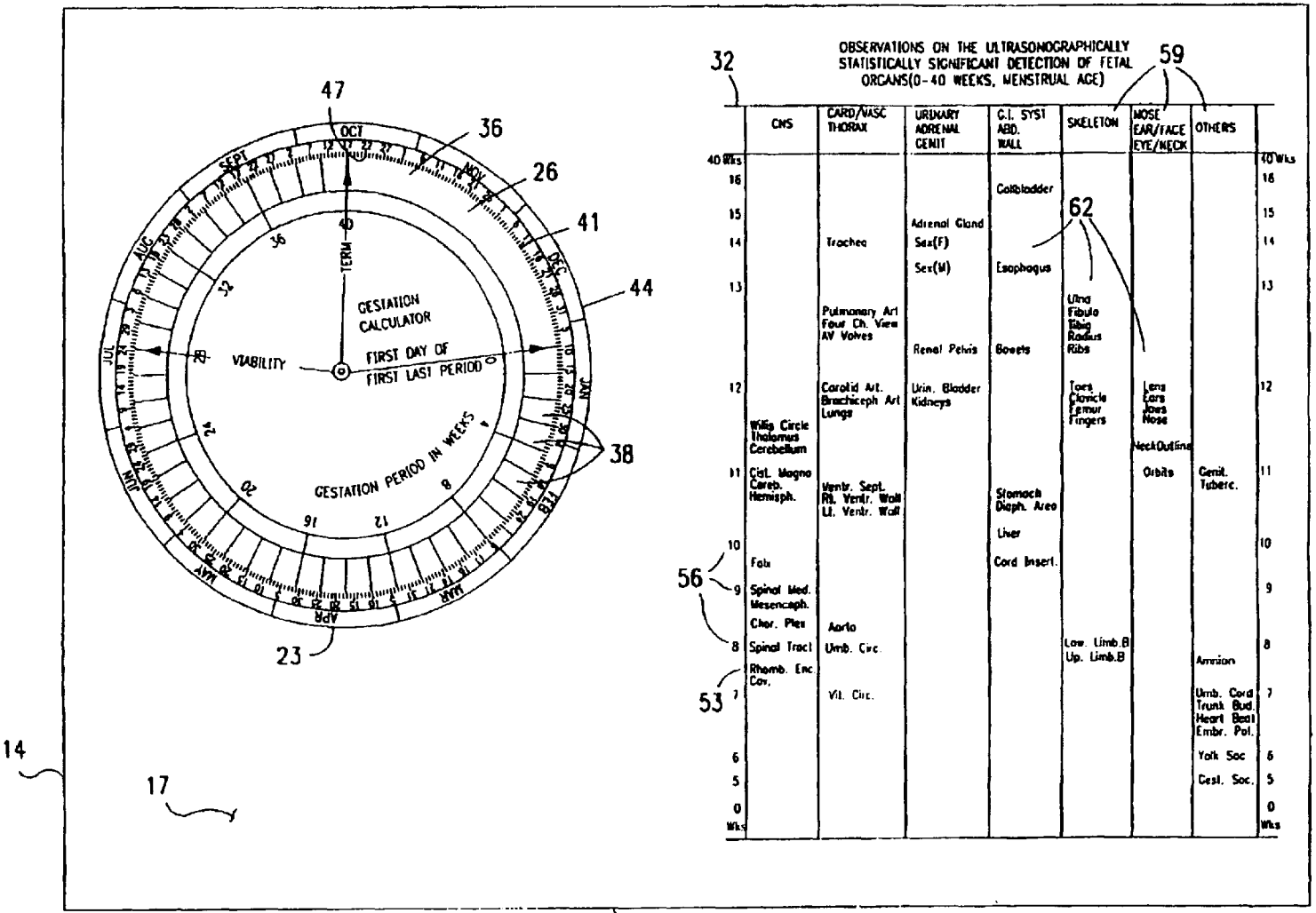
FIG. 1 is a top plan view of the feto-maternal calendar calculator of the present invention.

One embodiment of the feto-maternal calendar calculator 10 comprises a flat rectangular card 14 having flat top and bottom surfaces 17, 20. The card 14 is formed of a suitable material on which printing or labels may be applied on top and bottom surfaces 17, 20 thereof.

The calendar calculator 10 also includes a gestation calculator 23. Gestational calendars, such as gestational calendar 23 are known in the art. Gestational calculator 23 includes a gestation period disk 26 rotatably connected at the center thereof to the top surface of card 14 by a hub 29. The disk 26 thereby overlays a portion of top surface 17, where top surface 17 allows space for a fetal organ chart 32, described hereinbelow. Disk 26 has an upper surface 35 on which are printed equally-spaced radial indicia 38 adjacent to the outer edge 41 of disk 26. Each indicia 38 represents a gestation period of one week. One of the indicia 38*a* is labelled "FIRST DAY OF LAST PERIOD", the 28th indicia from indicia 38*a* is labelled"VIABILITY" and the 40th indicia from indicia 38*a* is labelled"TERM". These labels each represent events which normally occur at the weeks of a pregnancy represented by the corresponding indicia.

Gestation calculator 23 further includes an annular calendar 44 printed on top surface 17 adjacent to and concentric with gestational period disk 26. It is also possible for annular calendar 44 to be printed on an outer disk (not shown) which is in turn fixed to top surface 17. In such an alternative arrangement, gestational period disk 26 would be concentric with the outer disk and rotatably connected at its center to the center of the outer disk. The gestational period disk 26 may also be rotatably connected to card 14 in a manner similar to that shown in FIG. 1.

The annular calendar 44 is defined by an inner edge 47 concentric with outer edge 41 and adjacent thereto. The annular calendar 44 further includes equally spaced radial indicia 50 printed on top surface 17 adjacent to inner edge 47 where each indicia 50 represents a day of a calendar year as shown in FIG. 1.

The gestation calculator 23 may be used to calculate, for a given calendar date, how many weeks of the pregnancy have transpired by rotating gestation period disk 26 so that the indicia 38*a* labelled "FIRST DAY OF LAST PERIOD" points to the indicia 50 contained in annular calendar 44 representing the actual date of the first day the women's last period. After disk 26 is so positioned, the indicia 50 within annular calendar 44 representing the current date is identified. Indicia 50 within annular calendar 44 representing the current date will have pointing thereto an indicia 38 on disk 26 representing the number of weeks elapsed since the pregnancy began.

In one embodiment, fetal organ chart 32 is printed on top surface 17, preferably adjacent to gestation calculator 23, as shown in FIG. 1. The fetal organ chart 32 may alternatively be printed on a label which is affixed to top surface 17. If the size of fetal organ chart 32 requires a substantial area of top surface 17, card 14 may be scored, grooved or otherwise dented to define creases about which card 14 may be folded when not in use to make the calendar calculator 10 more compact. Card 14 may have more than one such crease so that folding and unfolding the card resembles an accordion.

Fetal organ chart 32 includes an ordinate 53 along which are printed numerals 56 increasing in magnitude in the upward direction as viewed in FIG. 1. Each numeral 56 represents the week into the pregnancy of a woman such that the greater the distance of a point on ordinate 53 from the bottom thereof, as viewed in FIG. 1, the longer the duration of the pregnancy. Fetal organ chart 32 also has a series of columns 59 each containing a system grouping its related organs 62 of a fetus. The names of the organs 62 are printed at the elevation of ordinate 53, as viewed in FIG. 1, representing the week into the pregnancy when the respective organ is expected to be first observable. The data regarding observability of the organs is determined from a statistically significant portion of the. population via ultrasonography or other tests.

Fetal organ chart 32 may be used by locating the elevation along ordinate 53 corresponding to the current duration of a woman's pregnancy, hereinafter referred to as the organ reference elevation. The names of organs 62 contained in the various columns 59 which are positioned at the same or a lower elevation relative to the organ reference elevation will ordinarily be visible via a sonogram taken during the week into the pregnancy represented by the organ reference elevation.

Figure 2:
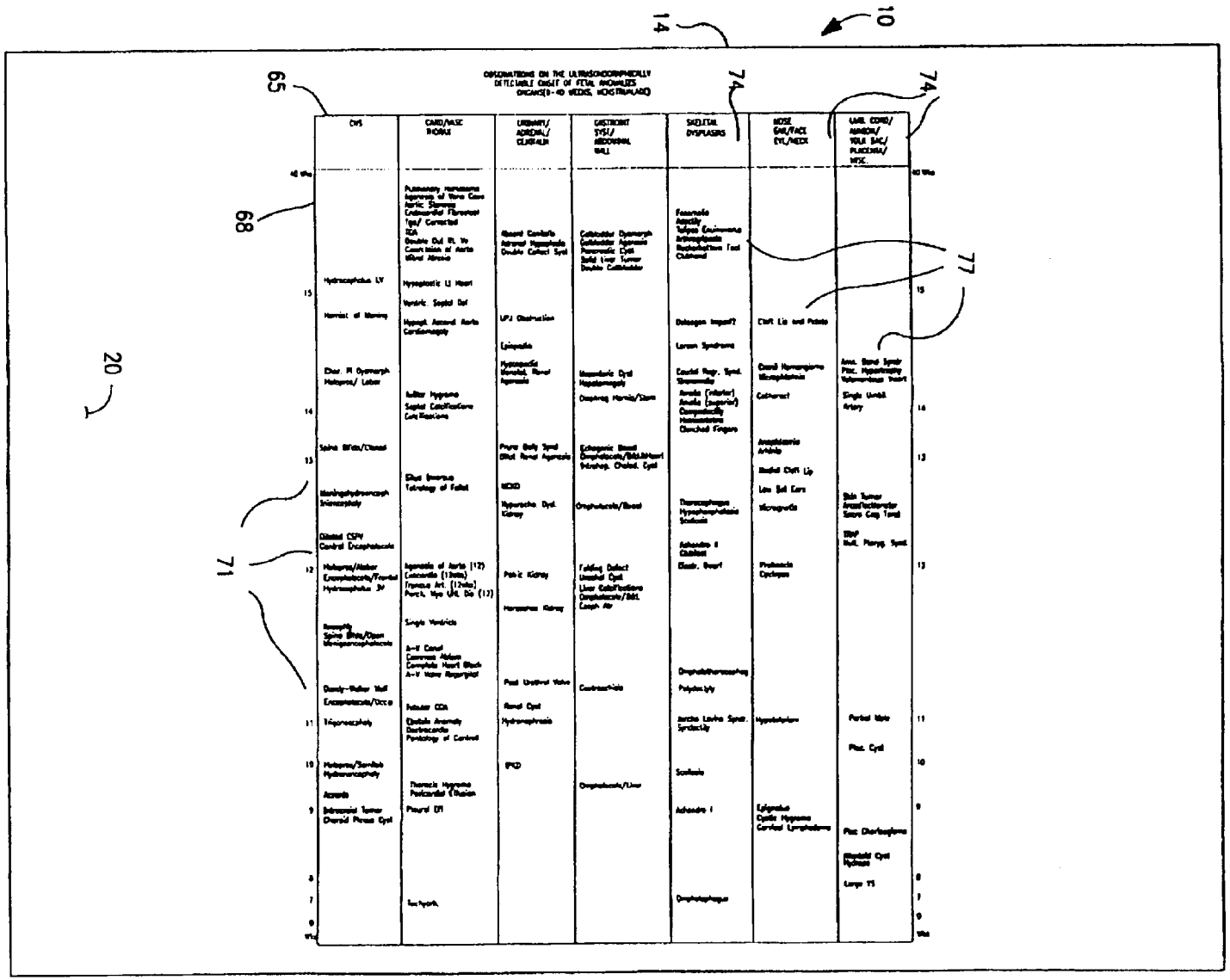
FIG. 2 is a bottom plan view of the feto-maternal calendar calculator of FIG. 1.

Fetal anomaly chart 65 is shown in FIG. 2 located on the bottom surface 20 of card 14. Fetal anomaly chart 65 may alternatively be printed on a label affixed to bottom surface 20. Fetal anomaly chart 65 includes an ordinate 68 along which are printed numerals 71 increasing in magnitude in the upward direction as viewed in FIG. 2. Each numeral 71 represents the week into the pregnancy of a woman such that the greater the distance of a point on ordinate 68 from the bottom thereof, the longer the duration of the pregnancy. Fetal anomaly chart 65 has generally the same vertical orientation as fetal organ chart 32 such that the respective tops thereof are adjacent to the same edges of card 14. Fetal anomaly chart 65 also has a series of columns 74 each identifying an anatomical system, grouping its related anomalies 77 which may be present in a fetus. The names of the anomalies 77 are printed at the elevation of ordinate 68, as viewed in FIG. 1, representing the week into the pregnancy of a woman when the respective anomaly may be first observable via a sonogram.

Fetal anomaly chart 65 may be used by locating the elevation along ordinate 68 corresponding to the current duration of a woman's pregnancy, hereinafter referred to as the anomaly reference elevation. The names of the anomalies 77 contained in the various columns 74 which are positioned at the same or a lower elevation relative to the anomaly reference elevation will ordinarily be visible via a sonogram taken during the week into the pregnancy represented by the anomaly reference elevation.

In use, gestation period disk 26 of the gestation calculator 23 is rotated as described above to determine the current week into a woman's pregnancy. Next, the elevation of the ordinate 53 of fetal organ chart 32 corresponding to the week calculated by gestation calculator 23 is identified in fetal organ chart 32, i.e., the organ reference elevation. Locating fetal organ chart 32 adjacent to the gestation calculator 23 results in ordinate 53 being adjacent to gestation calculator 23. thereby facilitating movement of the user's eyes from calculator 23 to chart 32. After identifying the organ reference elevation, the organs which are normally visible via a sonogram at the calculated duration of the pregnancy may be determined. The card 14 may then be flipped over to view fetal anomaly chart 65 on bottom surface 20. The elevation of ordinate 68 of fetal anomaly chart 65 corresponding to the week calculated by gestation calculator 23 is identified in the fetal anomaly chart, i.e., the anomaly reference elevation. After identifying the anomaly reference elevation, the anomalies which are normally visible via a sonogram at the calculated moment of the pregnancy may be determined. Identification of organs and anomalies in a sonogram during the taking of the sonogram, i.e., in "real time" is thereby facilitated.

The calendar calculator 10 may also include an elongate guide structure (not shown), such as a straightedge or ruler, having at least one flat surface for overlaying the regions of top and bottom surfaces 17, 20 containing fetal organ and anomaly charts 32, 65. The guide structures overlay respective charts 32. 65 in generally perpendicular orientations relative to respective ordinates 53, 68. The guide structures are movable relative to top and bottom surfaces 17, 20 in at least the direction parallel to respective ordinates 53, 68. An example of connecting the guide structure to card 14 enabling such movement is one or more pins (not shown) extending from the guide structure into corresponding slots (not shown) formed in card 14 where the slots are parallel to respective ordinates 53, 68. Other configurations for connecting the guide to card 14 are possible.

In use such guide structure is positioned so the lower edge thereof coincides with the reference elevation along respective ordinates 53, 68 corresponding to the week calculated by gestation calculator 23. The guide structure is thereby positioned above the fetal organs and/or anomalies 62, 77 which are normally visible via a sonogram after the number of weeks calculated by the gestation calculator 23. Identification of the portions of fetal organ and anomaly charts 32, 65 below the reference elevation, corresponding to the week calculated by gestation calculator 23, is thereby possible without referring back to the numerals 56, 71 adjacent to ordinates 53, 68 which may in turn require remembering the week calculated by gestation calculator 23 or referring back thereto. Efficiency and ease of examining fetal organ and anomaly charts 32, 65 may thereby be improved. The portions of charts 32, 65 below the reference elevation, corresponding to the week calculated by gestation calculator 23, is typically of interest to the examining physician since these portions of charts 32, 65 contain organs and anomalies 62, 77 which if present are normally visible via a sonogram. The guide structure may be opaque, have windows or be completely transparent.

The guide structures may be movable by applying a force directly thereto, e.g., by hand, in the desired direction of movement of the guide structure. The force may be-applied through a mechanical linkage with gestation period disk 26 such that rotation of disk 26 will produce concomitant movement of the guide structure. Such a linkage may be calibrated to automatically position either or both guide structures so that the lower edges thereof coincide with the week into the pregnancy calculated by gestation calculator 23.

An alternative embodiment of the calendar calculator 10 includes a radial window (not shown) formed in gestation period disk 26 and information on fetal development printed on portions of top surface 17 overlain by disk 26. This information on fetal development is positioned on gestation period disk 26 such that when disk 26 is rotatably positioned to calculate the current week into a woman's pregnancy, fetal information corresponding to the calculated week into the pregnancy is displayed through the window of disk 26. When the information obtainable thereby displayed contains the data of fetal organ and anomaly charts 32, 65, the content of charts 32, 65 thereof may be reduced, or, possibly, one or both charts 32, 65 eliminated entirely. Reductions in the content of charts 32, 65 may reduce the required size of card 14 allowing card 14 to be circular and concentric with gestation period disk 26.

In a still further alternative embodiment, calendar calculator 10 may include charts and/or nomograms of other feto/maternal tests other than the ultrasonography described above in connection with fetal organ and anomaly charts 32, 65.

Figure 5:
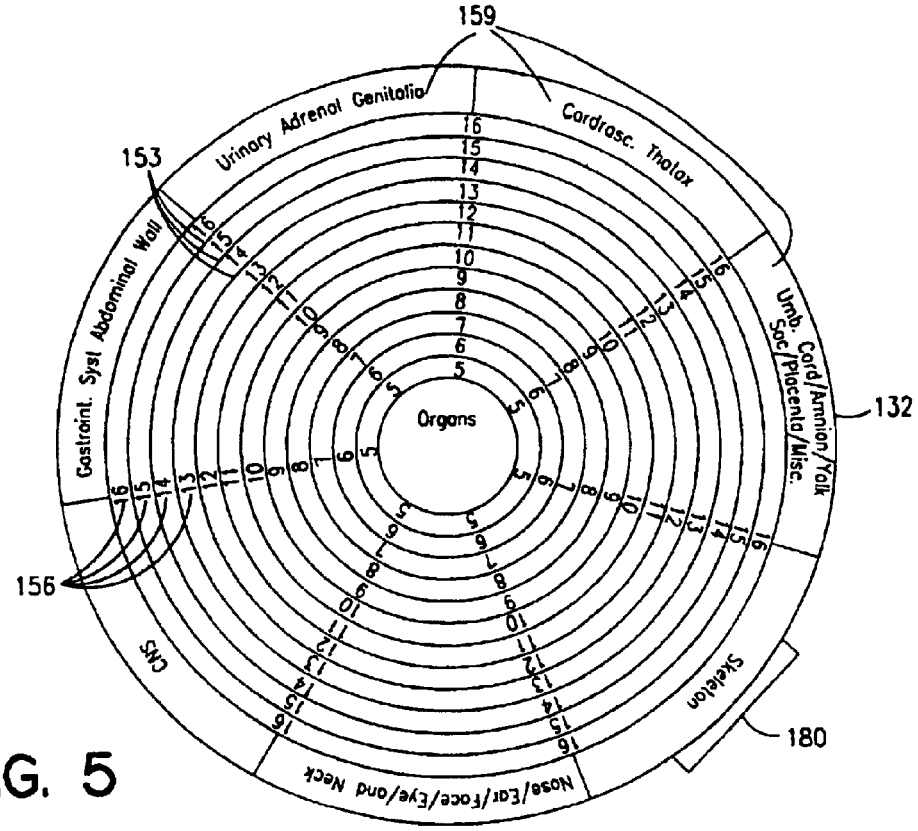
FIG. 5 is a top view of the fetal organ chart 132 shown in a circular chart format.
Figure 6:
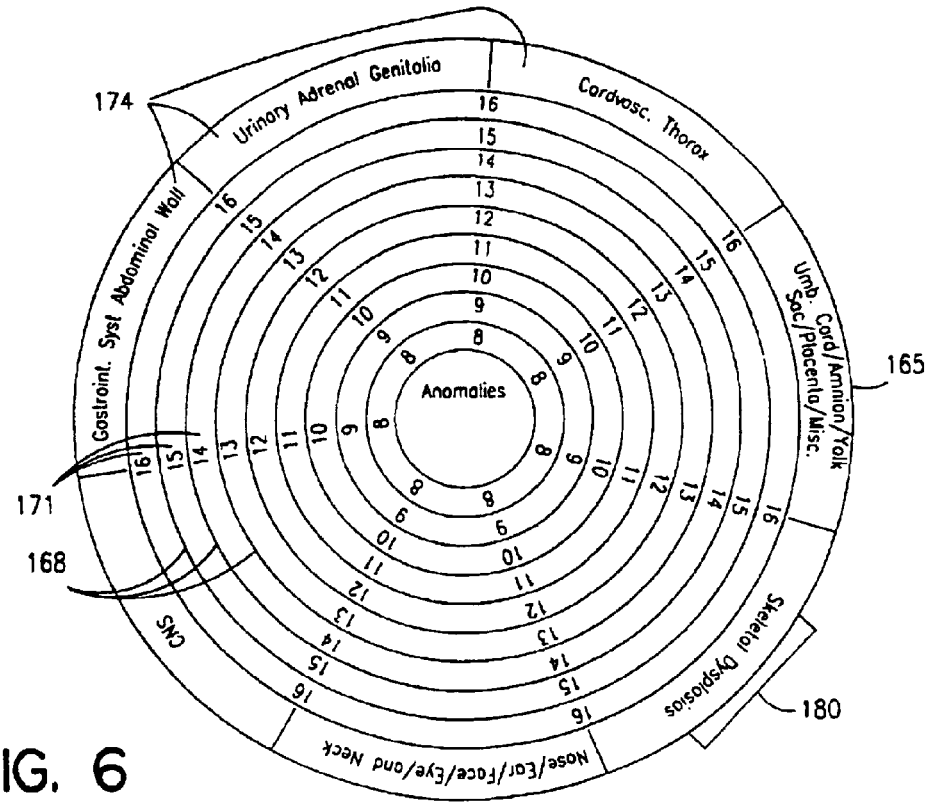
FIG. 6 is a top view of the fetal anomaly chart 165 shown in a circular chart format.

In another embodiment, the calendar calculator 10 may include circular charts, such as those shown in FIGS. 5 and 6 as fetal organ and anomaly charts 132, 165. These charts may operate in conjunction with or independent from the gestational period disk 26. Fetal organ chart 132 includes circles 153 upon which are printed numerals 156, representing weeks of the pregnancy, where the value of numerals 156 increases in magnitude in a direction along a radius of the circle formed by the chart 132. Fetal organ chart 132 also has a series of wedges 159 each containing a system grouping related organs of a fetus. The names of the organs are printed at the radial distance of circles 153, representing the week into the pregnancy when the respective organ is expected to be first observable.

Fetal anomaly chart 165 includes circles 168 upon which are printed numerals 171, representing weeks of the pregnancy, where the value of numerals 171 increases in magnitude in a direction along a radius of the circle formed by the chart. Fetal anomaly chart 165 has generally the same orientation as fetal organ chart 132 such that the charts may be overlaid. Fetal anomaly chart 165 also has a series of wedges 174 each identifying an anatomical system, grouping related anomalies which may be present in a fetus. The names of the anomalies are printed at the radial distance of circles 168, representing the week into the pregnancy of a woman when the respective anomaly may be first observable.

As an additional feature, movable guides (not shown) may be affixed to the circular charts, where such guides selectively reveal and cover organ names 162 or anomaly names 177, allowing the user of the invention to focus easily on the relevant data. One embodiment of the guide would be rotably affixed at the center of the circular charts.

The calendar calculator 10 may have a plurality of rotatable disks 26 rotatably connected to card 14, or to each other, where each rotatable disk provides feto-maternal information as described above. Card 14, with one or more disks 26 attached. may creased between the disks so that card 14 may be folded in the manner of an accordion to a closed position where the disks become sandwiched between sections of card 14. Alternatively, more than one such rotatable disk may be attached to separated sections of card 14 where the ends of the cards are rotatably connected as at tab 180 such that the cards open in the manner of a fan.

In another embodiment, the calendar calculator may be implemented in software, where such software may operate independent from, or in conjunction with, diagnostic aids.

It will be appreciated that the above is merely illustrative of a few embodiments, and that modifications of detail or assembly such as inner and outer charts/discs rotatably connected or back to back operated, or disclosing windows of feto-maternal information, or ruler format or any other formats, can be made without departing from the scope and principles of the invention.

While certain novel features of this invention have been shown and described, it will be understood that various omissions, substitutions and changes in the forms and details of the device illustrated and in its operation can be made by those skilled in the art without departing from the spirit of the invention.

What is claimed is:

1. A feto-maternal calendar calculator comprising:

a gestational age calculator for calculating a fetal gestational age;

a first data set comprising at least one of fetal organ appearance data, fetal anomaly appearance data, maternal drug intake interaction data, genetic abnormality data, and fetal biochemical data, said data set being indexed by gestational age; and means for viewing a subset of the first data set, which subset comprises a range of preselected gestational ages, where the calculated fetal gestational age falls between the preselected gestational ages.

2. The calendar calculator of claim 1 wherein the first data set is further indexed by at least one of fetal organ systems and Fetal maternal compartments.

3. The calendar calculator of claim 1 further comprising means for correlating the fetal gestational age with the first data set to produce a second, time-oriented data set, where such second data set is a subset of the first data set.

4. The calendar calculator of claim 1 wherein the subset of the data set is limited to a class of information selected from at least one of a fetal organ system and a fetal maternal compartment.

5. The calendar calculator of claim 1 wherein said gestational age calculator is an analog calculator, and said fetal organ data and said fetal anomaly data are charts correlating gestational age with fetal organ appearance and fetal anomaly appearance respectively.

6. The calendar calculator of claim 5 wherein each of said charts is printed on or affixed to a first substrate;

said gestational age calculator is printed on or affixed to a second substrate having movable portions permitting alignment of a first day of a pregnant female's last menstrual period with an actual calendar date on which said first day occurred and showing thereby a gestational age of a fetus on any calendar date of interest; and said gestational age calculator being affixed to a surface of said first substrate.

7. The calendar calculator of claim 1 wherein said gestational age calculator is a circular gestational age calculator affixed to a substrate; and said data set is displayed on a circular chart.

8. The calendar calculator of claim 7 further comprising a plurality of data sets displayed on circular charts, wherein each of said gestational age calculator and said circular charts is affixed to different portions of a single substrate, which substrate is capable of being folded with said gestational age calculator and said circular charts attached so that the calendar calculator may be carried in a pocket.

9. The calendar calculator of claim 7 wherein each of said gestational age calculator and said circular charts further comprise a tab on at least one portion of the circumference thereof, and each of said gestational age calculator and said circular charts are movably connected to at least one of the others at a point on said tabs, such that when moved into a closed position the gestational calculator and said circular charts have a compact appearance.

10. The calendar calculator of claim 9 wherein, when fully opened, the gestational calculator and said circular charts are capable of being viewed simultaneously, giving the appearance of disks in a fan shape or as a chain of disks or a combination thereof.

11. A method of determining appropriate diagnostic tests to perform on a pregnant female and on a developing fetus comprising:

obtaining a calendar date on which said pregnant female had a first day of here last menstrual period before becoming pregnant;

entering said calendar date into a feto-maternal calendar calculator;

obtaining an output of a gestational age of said fetus on a given date and at least one of fetal organs detectable by a diagnostic technique on or about a given date;

fetal abnormalities detectable by a diagnostic technique on or about a given date;

maternal drug intake interactions with the fetus on or about a given date;

genetic abnormalities detectable by a diagnostic technique on or about a given date; and fetal biochemical data detectable by a diagnostic technique on or about a given date.

12. The method of claim 11, wherein the given date is the calendar date.

13. A feto-maternal calendar calculator comprising a circular substrate having two sides;

a gestational calculator affixed to one side of the circular substrate; and a circular chart on the opposite side of the circular substrate, where the circular chart comprises a data set comprising at least one of fetal organ appearance data, fetal anomaly appearance data, maternal drug intake interaction data, genetic abnormality data and fetal biochemical data, said data set being indexed by gestational age.

* * * * *